United States Patent [19]

Kishino et al.

[11] 4,270,068

[45] May 26, 1981

[54] FLUORESCENT DISPLAY DEVICE

[75] Inventors: Takao Kishino; Kishio Kawasaki; Nobuo Yamaguchi, all of Mobara, Japan

[73] Assignee: Futaba Denshi Kogyo K.K., Mobara, Japan

[21] Appl. No.: 946,731

[22] Filed: Sep. 28, 1978

[30] Foreign Application Priority Data

Oct. 6, 1977 [JP] Japan ..... 52-133663[U]

[51] Int. Cl.[3] ..... H01J 1/72; H01J 61/66

[52] U.S. Cl. ..... 313/497

[58] Field of Search ..... 313/497, 496, 495

[56] References Cited

U.S. PATENT DOCUMENTS

| | | | |
|---|---|---|---|
| 2,686,273 | 8/1954 | Hough et al. | 313/190 |
| 3,868,535 | 2/1975 | Kupsky | 313/519 |
| 3,903,448 | 9/1975 | Kuchinsky et al. | 313/519 |

*Primary Examiner*—Segal Robert

*Attorney, Agent, or Firm*—Oblon, Fisher, Spivak, McClelland & Maier

[57] ABSTRACT

A fluorescent display device having at least a filamentary cathode for emitting electrons, pattern display sections each coated with fluorescent material, a plurality of control electrodes electrically independent of one another provided opposite to the pattern display sections respectively, the anodes and control electrodes being selectively given drive signals thereby to make the electrons emitted from the filamentary cathode impinge on the anodes so as to display characters, numerals, graphic forms and the like on the pattern display sections, and a plurality of auxiliary electrodes provided at or above and in the vicinity of gaps between the control electrodes respectively and at all times kept at a positive potential with respect to the filamentary cathode so that the mutual influence of the control electrodes may be intercepted.

1 Claim, 6 Drawing Figures

FLUORESCENT DISPLAY DEVICE

BACKGROUND OF THE INVENTION

1. Field of the Invention

The present invention relates to a fluorescent display device, and more particularly to a fluorescent display device which has a plurality of pattern display sections each composed of a plurality of fluorescent anodes, and which can arrange the pattern display sections at close intervals and, in addition, can give a high-quality fluorescent display with no display defects.

2. Description of the Prior Art

Fluorescent display devices, which feature good color of fluorescence, low-voltage drive, small power consumption, etc., have been frequently used as the display devices of various electronic apparatuses and the like.

With the increase or diversification of the information content to be processed by the electronic equipment or the like, it has become a general practice for the fluorescent display device to adopt a so-called multi-digit display mechanism in which a plurality of pattern display sections are provided on a substrate side by side and, in addition, to be adapted to display characters, numerals, figures, and the like.

In order to drive the above-mentioned so-called multi-digit pattern display sections, usually adopted is the dynamic drive system which can function with only a small number of outside-leading or external terminals and also with a small number of drive circuits.

For instance, the fluorescent display device which displays characters and the like by the use of dot matrices as shown in FIG. 1 is constructed and operated as follows:

Each of pattern display sections 1 (1*a*, 1*b*, 1*c*, . . . ) is composed of a plurality of dot-shaped anodes 2 each coated with fluorescent material. The anodes 2 are electrically connected by wiring conductors (not shown) so that those provided at the corresponding positions of the respective pattern display sections 1(1*a*, 1*b*, 1*c*, . . . ) are connected in common. The groups of corresponding anodes 2 thus connected are also connected to external terminals (not shown), respectively. Mesh-like control electrodes 3(3*a*, 3*b*, 3*c*, . . . ) (hereinafter referred to as grids) electrically independent of one another are provided above and opposite to the pattern display sections 1(1*a*, 1*b*, 1*c*, . . . ), being connected to external terminals (not shown), respectively. One or a plurality of filamentary cathodes 4, or filaments, which emit thermions when heated, are provided above and across the grids 3. The above-mentioned pattern display sections 1, grids 3 and filaments 4 are fixedly contained in a high-vacuum container (not shown), or package, so that the above-mentioned external terminals airtightly pass through the wall of the package. In operation, the anodes 2 are selectively given an anode voltage, while the grids 3 are given a grid voltage successively in a time-sharing manner. Among the anodes 2 of the pattern display sections, those thus selected are bombarded with electrons or thermions emitted from the filament or filaments 4, and thereby emit light for display.

FIG. 2 shows another example of the fluorescent display device, which is constructed and operated as follows:

Each of pattern display sections 11 (11*a*, 11*b*, 11*c*, . . . ) is composed of a plurality of anodes 2 coated with fluorescent material and arranged in a file or column.

The pattern display sections 11 are equally spaced. In addition, the anodes 2 are electrically connected so that those disposed at the corresponding positions of the respective pattern display sections 11, or on the same row thereof, are connected in common. The groups of the anodes 2 thus connected are in turn connected to external terminals, respectively. Grids 13(13*a*, 13*b*, 13*c*, . . . ) electrically independent of one another are provided above the pattern display sections 11 (11*a*, 11*b*, 11*c*, . . . ), respectively.

In operation, the grids 13(13*a*, 13*b*, 13*c*, . . . ) are successively scanned, for instance, from left to right in FIG. 2, while the anodes 2 are given an anode voltage in synchronization with the above-mentioned scanning. Thus, fluorescent display can be performed.

In this example, as mentioned above, the pattern display sections 11(11*a*, 11*b*, 11*c*, . . . ) are equally spaced, and each of them consists of a plurality of anodes 2 arranged in a file or column. Therefore, it becomes possible to display characters and the like while moving them, for instance, from left to right in FIG. 2, or to dynamically display graphic symbols and the like.

In the above-mentioned examples, the fluorescent display device has grids 3 or 13 provided between the pattern display sections 1 or 11 and the filaments 4, one for each display section; the grids 3 or 13 are scanned in a time-sharing manner thereby making the pattern display sections 1 or 11 fluoresce for display. The fluorescent display device of this type has an advantage in that it can reduce the number of external terminals and that of drive circuits. However, it has such a disadvantage that display imperfections tend to occur on the anodes 2 positioned in the vicinity of the gaps between the grids 3 or 13. It is considered that these display imperfections are attributable to the following reasons:

FIG. 3 shows schematically how the above-mentioned conventional fluorescent display device works. When a pattern display section 1*b* provided on a substrate 5 is to be scanned, a grid 3*a* positioned at the left side of FIG. 3 is given a potential equal to that (zero) of the filaments 4 or lower (negative), while a grid 3*b* positioned at the right side of FIG. 3 is given a positive potential. In this case, the potential distribution in the vicinity of the filaments 4 and the gap "g" existing between the grids 3*a* and 3*b* may be shown by broken lines in FIG. 3.

Accordingly, electrons "e" passing through the meshy portion of the grid 3*b* and moving toward the anodes 2 of the pattern display section 1*b* are urged rightward by the action of an electric field formed by the negative potential given to the grid 3*a*. As a result, on the anodes 2 positioned in the vicinity of the gap "g" between the grids 3*a* and 3*b*, there appear regions where electrons "e" are not or insufficiently supplied. The regions on which no electron impinge become, for instance, display-defect regions S as shown in FIG. 1 thereby deteriorating the quality and clearness of fluorescent display. In addition, if the display-defect regions S further widen, it becomes impossible to accurately display the desired shape.

One of the conventional practices for preventing the occurrence of the above-mentioned display-defect regions S is to provide the pattern display sections at wider intervals so that an electric field formed by a grid 3 corresponding to a pattern display section 1 adjacent to that of interest may not have influence on the anodes 2 of the latter.

For instance, if the distance $l_1$ between the left-end boundary of the anode area of the pattern display section 1b and the left-end line of the meshy portion "m" of the grid 3b is sufficiently increased, it becomes possible to prevent the occurrence of the above-mentioned display-defect regions S.

In this practice, however, the distance L between the pattern display sections 1a and 1b becomes very great, since the distance L has the following relationship:

$$L=2(l_1+l_2)+l_3$$

where $l_1$ is defined as above or the distance between the right-end boundary of the anode area of the pattern display section 1a and the right-end line of the meshy portion "m" of the grid 3a, $l_2$ the width of the frame portion "f" of each of the grids 3a and 3b, and $l_3$ the space between the grids 3a and 3b. As a result, it becomes difficult to perform fine and accurate display and, in addition, to make the pattern display sections compact.

SUMMARY OF THE INVENTION

Therefore, the present invention is intended to eliminate the above-mentioned disadvantages of the prior art.

It is an object of the present invention to provide a fluorescent display device which can dispose the pattern display sections at close intervals.

It is another object of the present invention to provide a fluorescent display device which can perform excellent fluorescent display even when the pattern display sections are disposed at close intervals.

According to the present invention, there is provided a fluorescent display device having at least a filamentary cathode for emitting electrons, a plurality of pattern display sections each composed of a plurality of anodes each coated with a fluorescent material layer, a plurality of control electrodes electrically independent of one another provided opposite to the pattern display sections respectively, the anodes and the control electrodes being selectively given drive signals thereby to make the electrons emitted from the filamentary cathode impinge on the anodes so as to display characters, numerals, graphic forms and the like on the pattern display sections, the device comprising a plurality of auxiliary electrodes provided at or above and in the vicinity of gaps between the control electrodes respectively and at all times given a positive potential with respect to the filamentary cathode.

In the fluorescent display device of the present invention, a positive electric field formed by the auxiliary electrode intercepts a negative electric field formed by the grid thereby eliminating the influence of the above-mentioned negative electric field on a grid adjacent to the above grid. Thus, the occurrence of display defects can be prevented and therefore an excellent fluorescent display can be obtained even when the pattern display sections are provided at close intervals.

DETAILED DESCRIPTION OF THE PREFERRED EMBODIMENT

A preferred embodiment of the present invention will be hereinafter described with reference to the accompanying drawings.

First described with reference to FIG. 4 will be how the fluorescent display device of the present invention works.

Figure 4:
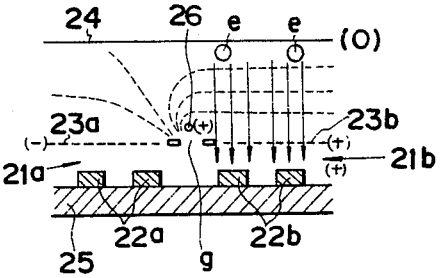
FIG. 4 is a sectional view of the essential part of the fluorescent display device of the present invention, prepared for the assistance in explaining the operation of the device.

In FIG. 4, reference numeral 25 designates a substrate made of insulating material, as glass or ceramics, on which anodes 22 (22a and 22b) each coated with a fluorescent layer are provided. The anodes 22 (22a and 22b) form adjacent pattern display sections 21 (21a and 22b). In other words, the anodes 22a form the pattern display section 21a, and the anodes 22b form the pattern display section 21b.

Reference numerals 23a and 23b designate control electrodes, or grids, electrically independent of each other provided above and in the vicinity of the pattern display sections 21a and 21b, respectively. Reference numeral 24 designates one or a plurality of filamentary cathodes, or filaments, which emit thermions when heated.

Reference numeral 26 designates an auxiliary electrode of conductive material provided above and in the vicinity of a gap "g" between the grids 23a and 23b and at all times given a positive potential with respect to the filament or filaments 24.

Figure 3:
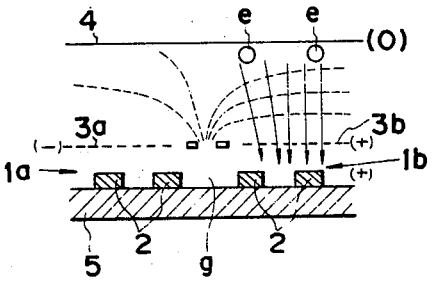
FIG. 3 (PRIOR ART)
FIG. 3 is a sectional view of the essential part of the conventional fluorescent display device, prepared for the assistance in explaining the operation of the device.

By comparison with the conventional fluorescent display device shown in FIG. 3, it is apparent that the fluorescent display device of the present invention is characterized by the provision of the auxiliary electrodes disposed above and in the vicinity of the gaps "g" between the adjacent grids 23.

The fluorescent display device of the present invention constructed as above may be operated as follows:

When the anodes 22b of the pattern display section 21b are to be made to emit light by the dynamic drive system, the anodes 22b and the gride 23b are given positive potentials with respect to the filament or filaments 24, respectively. Meanwhile, the grid 23a is kept at a negative potential equal to or greater than the filament or filaments 24.

In addition, the auxiliary electrode 26 is given a positive potential at all times during the operation of the device. Accordingly, the potential distribution around the grids 23a and 23b and the auxiliary electrode 26 may be shown by broken lines in FIG. 4. More particularly, the negative electric field formed by the grid 23a is urged toward the pattern display section 21a by the positive electric field formed by the auxiliary electrode 26, and, therefore, the positive electric field formed by the grid 23b is not disturbed by the negative electric field formed by the grid 23a.

Thus, under the influence of the combined positive electric field formed by the grid 23b and the auxiliary electrode 26, electrons "e" emitted from the filament or filaments 24 are accelerated toward the anodes 22b thereby impinging uniformly on all the anodes 22b. It should be noted that, in this case, the above-mentioned combined positive electric fields not influenced by the negative field formed by the grid 23a fully cover the end portions of the anodes 22b facing the pattern display section 21a, and therefore the electrons "e" can impinge on these end portions also.

As a result, all the anodes 22b uniformly emit light without being influenced by the negative electric field formed by the grid 23a of the adjacent pattern display section 21a.

By provision of the auxiliary electrode 26 kept at a positive potential, as mentioned above, the fluorescent display device of the present invention can remove the mutual influence of the grids 23 of the pattern display sections 21 adjacent to each other, and therefore can prevent display defects from occurring on the end portions of each pattern display section 21 and, in addition, can dispose the pattern display sections 21 at close intervals.

Figure 5:
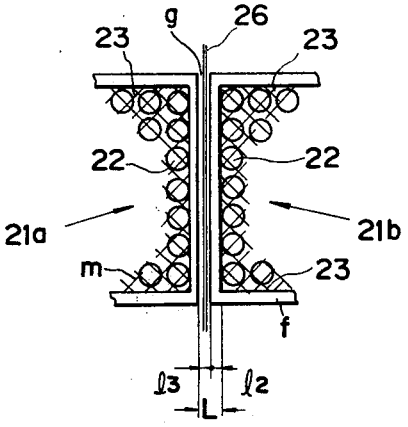
FIG. 5 is an enlarged plan view of the essential part of the fluorescent display device according to a preferred embodiment of the present invention.

As shown in FIG. 5, for instance, it becomes unnecessary for the pattern display section 21a or 21b to provide a special space between the end of the array of the anodes 22 and the end of the meshy portion "m" of the grid 23.

Figure 1:
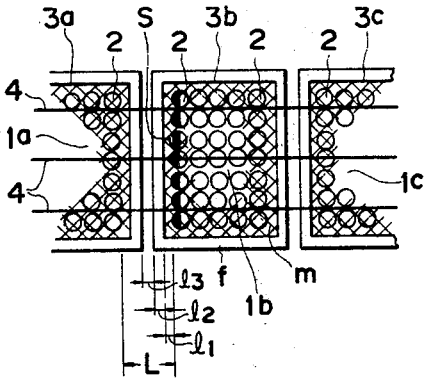
FIG. 1 (PRIOR ART)
FIG. 1 is a schematical plan view of the essential part of an example of the conventional fluorescent display device.

Accordingly, the distance L between the pattern display sections 21a and 21b may be expressed as follows:

$$L=2l_2+l_3$$

where $l_2$ is the width of the meshy portion of the grid 23 and $l_3$ is the distance between the grids 23. Therefore, compared with the conventional fluorescent device shown in FIG. 1 or 2, the fluorescent display device of the present invention can greatly reduce the interval between the pattern display sections 21.

Figure 2:
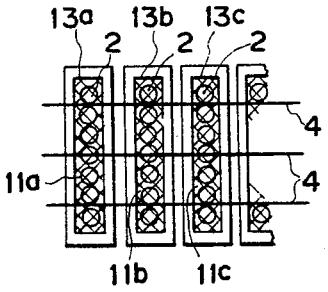
FIG. 2 (PRIOR ART)
FIG. 2 is a schematic plan view of the essential part of another example of the conventional fluorescent display device.

Thus, the fluorescent display device of the present invention can achieve a fine and delicate display and, in addition, can be made compact. Especially when each pattern display section is composed of a single column of anodes as shown in FIG. 2, the columns of the pattern display sections may be provided at close intervals and therefore fine and almost natural characters, graphic symbols and the like can be displayed.

How the auxiliary electrode 26 is provided for each gap "g" between the grids 23 of the pattern display sections 21 will be hereinafter described with reference to FIG. 6 by way of example.

Figure 6:
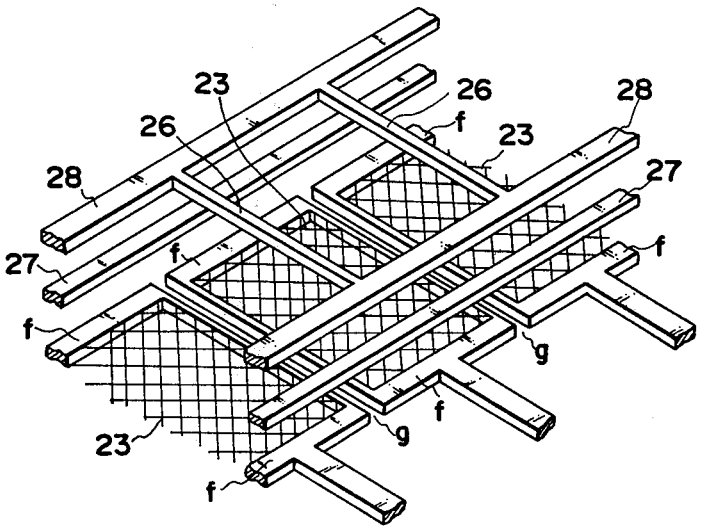
FIG. 6 is an exploded perspective view of the essential part of the fluorescent display device according to the above-mentioned embodiment of the present invention.

In FIG. 6, the grids 23 are provided side by side along, above and in the vicinity of the pattern display sections (not shown) with a gap "g" therebetween. A pair of spacers 27 made of insulating material, as ceramics or mica, are mounted on the opposite sides of the frames "f" of the grids 23. A pair of supporting members 28 made of conductive material previously integrated with the auxiliary electrodes 26 into a ladder-like assembly according to the sizes of the grid 23 and gap "g" are mounted on the spacers 27 respectively so that the auxiliary electrodes 26 may be positioned above and in the vicinity of the gaps "g".

The supporting members 28 may be made of any materials including conductive material. If the supporting members 28 are made of conductive material, they may be used as the power feeding path for the auxiliary electrodes 26 thereby making it possible to greatly simplify the method of giving a positive potential to the auxiliary electrodes 26.

In the above-mentioned embodiments, the auxiliary electrodes 26 are provided above and in the vicinity of the gaps "g" between the grids 23. However, they may be provided at the gaps "g" or above the ends of the grids 23. In addition, the auxiliary electrode 26 may take any shape, as a slender wire circular in cross section or an elongated strip, as necessary.

It will be understood from the foregoing description that the fluorescent display device of the present invention has the following features, advantages and effects:

The fluorescent display device of the present invention has a plurality of pattern display sections, grids provided for the respective pattern display sections side by side with gaps therebetween, auxiliary electrodes provided at or above and in the vicinity of the respective gaps, and at least one filament provided above and along the auxiliary electrodes, said auxiliary electrodes being kept at a positive potential with respect to the filament.

Accordingly, the influence of the negative electric field formed by the grid corresponding to an adjacent pattern display section is intercepted by the action of the auxiliary electrode. As a result, electrons emitted from the filament can uniformly impinge even on the anodes positioned at the ends of each pattern display section. Therefore the occurrence of display defects can be prevented and also a clear and high-quality fluorescent display can be obtained.

Besides, the mutual influence of the negative electric fields formed by the adjacent grids can be intercepted by the action of the auxiliary electrodes at all times kept at a positive potential. As a result, the pattern display sections may be provided at close intervals; the entire fluorescent display device can be made compact; and the fine and delicate display of a large amount of information can be accomplished in a given display area. Thus, the fluorescent display device of the present invention can become high in performance and can find wide application.

Obviously many modifications and variations of the present invention are possible in the light of the above teachings. It is therefore to be understood that within the scope of the appended claims the invention may be practiced otherwise than as specifically described.

What is claimed as new and desired to be secured by letters patent of the United States is:

1. In a fluorescent display device having at least a filamentary cathode for emitting electrons, a plurality of pattern display sections each composed of a plurality of anodes each coated with a fluorescent material layer, a plurality of control electrodes electrically independent of one another provided opposite to said pattern display sections respectively, said anodes and control electrodes being selectively given drive signals thereby to make the electrons emitted from said filamentary cathode impinge on said anodes so as to display characters, numerals, graphic forms and the like on said pattern display sections, the improvement which comprises a plurality of auxiliary electrodes provided at or above and in the vicinity of gaps between said control electrodes respectively and at all times kept at a positive potential with respect to said filamentary cathode; said positively charged auxiliary electrodes shaping an electric field formed above said anodes in order to make said electrons emitted from said filamentary cathode impinge uniformly on the entire surface area of said selected anodes to thereby prevent display defects, to produce uniform light emission for a clear fluorescent display and to decrease the space between said pattern display sections; said auxiliary electrodes being supported above and in the vicinity of said gaps by at least two conductive support members that are located perpendicular to said gaps and said auxiliary electrodes; and said auxiliary electrodes being spaced above and in the vicinity of said gaps by at least two insulating spacers that are located perpendicular to said gaps and said auxiliary electrodes; said at least two insulating spacers separating said at least two conductive support members from said control electrodes.

* * * * *